US011450162B2

(12) United States Patent
Kübler

(10) Patent No.: US 11,450,162 B2
(45) Date of Patent: Sep. 20, 2022

(54) DOOR LOCKING AND/OR OPENING SYSTEM, A METHOD FOR CONTROLLING DOOR LOCKING AND/OR OPENING, AND A DOOR LOCKING AND/OR OPENING AND DOCUMENTATION SYSTEM

(71) Applicant: Michael Kübler, Diez (DE)

(72) Inventor: Michael Kübler, Diez (DE)

( * ) Notice: Subject to any disclaimer, the term of this patent is extended or adjusted under 35 U.S.C. 154(b) by 0 days.

(21) Appl. No.: 17/128,190

(22) Filed: Dec. 20, 2020

(65) Prior Publication Data

US 2022/0198854 A1 Jun. 23, 2022

(51) Int. Cl.
*G07C 9/00* (2020.01)
*E05B 47/00* (2006.01)

(52) U.S. Cl.
CPC ..... *G07C 9/00571* (2013.01); *E05B 47/00* (2013.01); *E05Y 2400/44* (2013.01); *E05Y 2900/132* (2013.01)

(58) Field of Classification Search
CPC ..... G07C 9/005
See application file for complete search history.

(56) References Cited

U.S. PATENT DOCUMENTS 6,087,987 A * 7/2000 Bachhuber ..... B60R 25/24 307/10.5
7,180,454 B2 * 2/2007 Asakura ..... B60R 25/245 343/713
7,772,962 B2 * 8/2010 Labowicz ..... G07C 9/00912 340/5.72
8,471,676 B1 * 6/2013 Lizaso ..... E05G 5/003 340/5.2
9,870,460 B2 * 1/2018 Eberwine ..... G06F 21/34
10,515,493 B2 * 12/2019 Tse ..... G07C 9/37
10,572,645 B2 * 2/2020 Eberwine ..... G06F 21/34
2021/0312201 A1 * 10/2021 Hastings ..... G07C 9/00896

* cited by examiner

*Primary Examiner* — K. Wong
(74) *Attorney, Agent, or Firm* — NZ Carr Law Office PLLC; Chih Huai Chiu

(57) ABSTRACT

A door locking/opening system includes multiple doors, each configured with a door ID number, a handle, a lock and an I/O controller, the I/O controller controls the corresponding door; multiple door controllers, each door controller connects the I/O controller of the respective door and controls the corresponding door; multiple sensors, each sensor connects the respective door controller and communicates with the corresponding door; a door controller unit, connected with the respective door controller via a decentralized network and controlling the multiple door controllers; the multiple door controllers are digitally connected and communicating with each other via the decentralized network; each door controller contains its local logbook of own activities and a configuration file of the complete door locking and/or opening system, and each door controller configurated to update and synchronize the configuration file with each other in a rotating cycle based on the door ID numbers in an ascending order, beginning with the lowest door ID number.

18 Claims, 6 Drawing Sheets

DOOR LOCKING AND/OR OPENING SYSTEM, A METHOD FOR CONTROLLING DOOR LOCKING AND/OR OPENING, AND A DOOR LOCKING AND/OR OPENING AND DOCUMENTATION SYSTEM

BACKGROUND OF THE INVENTION

Field of the Invention

The present invention relates to a door locking system, and more particularly to a door locking and/or opening system and a method for controlling door locking and/or opening.

Description of Conventional Art

A conventional door locking and/or opening system normally is using multiple door controllers for multiple doors. In particular, each of the door controllers is connected with an I/O controller of the respective door, and controls the corresponding door via communicating with the respective I/O controller. The individual door controller is connected to and communicating with the corresponding door through its I/O controller, and controls the corresponding door. That is, multiple door controllers in the system only have connection or communication with the corresponding door for the users and administrators, independent from each other.

However, these multiple door controllers have no connection, communication or any control among or between the multiple door controllers. Under the regular mode, since each of the door controllers is separately connected with the I/O controller of the respective door, these door controllers are separated from each other. Thus, there is no controlling message or information exchange among or between the multiple door controllers.

Furthermore, there is no monitoring measure, a logbook of activities or a configuration file of the complete door locking and/or opening system.

Problem to be Solved

As mentioned above, since the door controllers are separated from each other, it is no possible to control other door(s) except its own door. Further, it also is no possible for the door controllers to update and synchronize within the complete system.

SUMMARY OF THE INVENTION

Solution for the Problem

This problem is solved by creating a decentralized network consisted of at least multiple door controllers. Additionally, the door controllers itself also contains a local logbook of own activities and a configuration file of the complete system which are needed for update and synchronization.

The present disclosure provides a door locking and/or opening system, comprising multiple doors, each configured with a door ID number, a handle, a lock and an I/O controller, the I/O controller is configured for controlling the corresponding door; multiple door controllers, each of the door controllers connected with the I/O controller of the respective door and controlling the corresponding door; multiple sensors, each of the sensors connected with the respective door controller and communicating with the corresponding door; a door controller unit, connected with the respective door controller via a decentralized network and controlling the multiple door controllers; the multiple door controllers are further digitally connected and communicating with each other via the decentralized network; each of the door controllers contains its local logbook of own activities and a configuration file of the complete door locking and/or opening system, and each of the door controllers is further configurated to update and synchronize the configuration file with each other in a rotating cycle based on the door ID numbers in an ascending order, beginning with the lowest door ID number.

Each of the door controllers preferably updates and synchronizes the local logbook with a central server according to a first selectable time schedule, and each of the door controllers updates and synchronizes the configuration file with each other according to a second selectable time schedule.

The network communication among the multiple door controllers preferably is encrypted and signed. The door controller unit is configured to maintain the configuration file, to distribute the configuration file to the door controllers, to store the local logbooks and to monitor the actions of each door controller in order to identify malfunctions or manipulations.

The I/O controllers preferably are a network-based I/O controller or a USB-based I/O controller, which is configurated to open or lock the corresponding door.

The system preferably further comprises a door control user panel, the door control user panel communicates with the door controller unit and/or with the network of the individual door controller.

The present disclosure also provides a door locking and/or opening and documentation system, comprising the door locking and/or opening system, wherein a documentation system comprising: a user terminal for second inspections; a frame Grabber to catch X-Ray screens; an X-Ray system for inspection; a webcam; an IP-Cam and a user terminal for screening operator.

The present disclosure provides a method for controlling door locking and/or opening, said method applied in a door locking and/or opening system comprising a first master door and multiple slave doors, each slave door associated with a door ID number, said method comprising steps of: receiving, by the first master door, a request for initiating an opening sequence; determining whether the first master door have an active locking sequence from other master doors; if the first master door has the active locking sequence from other master doors, denying the door-opening request; if the first master door does not have the active locking sequence from other master doors, checking a configuration database for relevant slave doors and status information; inquiring each of the slave door for its status and requesting a lock sequence reservation, in an order from a lowest door ID number to a highest door ID number, until all slave doors contacted confirms without any error message; determining whether the slave door confirms its status and the lock sequence reservation; if one of the slave doors does not confirm its status and the lock sequence reservation, sending cancellation of the lock sequence reservation to the slave door and denying the door-opening request; opening the first master door, and informing all slave doors when the door is closed again.

After the determining step and before the checking step, the method preferably further comprising steps of: informing a second master door that the first master door is requesting for the lock sequence reservation; determining whether the first master door has a lower priority level than the second master door; if the first master door has the higher priority level than the second master door, sending by the second master door a confirmation to the first master door with the higher priority, and continuing by the first master door with the locking sequence reservation until receiving new status information from the second master door; or if the first master door has the lower priority level than the second master door, canceling by the first master door all door locking reservations of the first master door, aborting a reservation sequence initiation by the first master door, and sending a configurable confirmation to the second master door.

Before the receiving step, the method preferably further comprising steps of: detecting, by any one of the master doors or the multiple slave doors, an event where an emergency opening of doors is requested; sending an emergency opening request to the master doors and the slave doors as defined in the database for the requesting event periodically or non-periodically.

Before the receiving step, the method preferably further comprising steps of: detecting, by any one of the master doors or the multiple slave doors, an event where a closing of doors is requested; sending a locking request to the master doors and the slave doors as defined in the database for the requesting event periodically or non-periodically.

When a pre-configured maximum reservation timer is reached, the complete locking sequence preferably is repeated for the configured maximum reservation duration before an error is shown, so as to prevent that some doors are kept locked and prevent restrictions to enter or leave an area.

A locking sequence preferably is transmitted in one frame.

The advantageous effects of the above distinguishing feature to the prior art are illustrated as below. Via the decentralized network the multiple door controllers are digitally connected and communicating with each other. The complete configuration file further enables the door controllers to update and synchronize with each other.

BRIEF DESCRIPTION OF DRAWING

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout two views. The invention itself may be best understood by reference to the following detailed description of the invention, which describes exemplary embodiments of the invention, taken in conjunction with the accompanying drawings, in which.

DETAILED DESCRIPTION OF THE INVENTION

Figure 1:
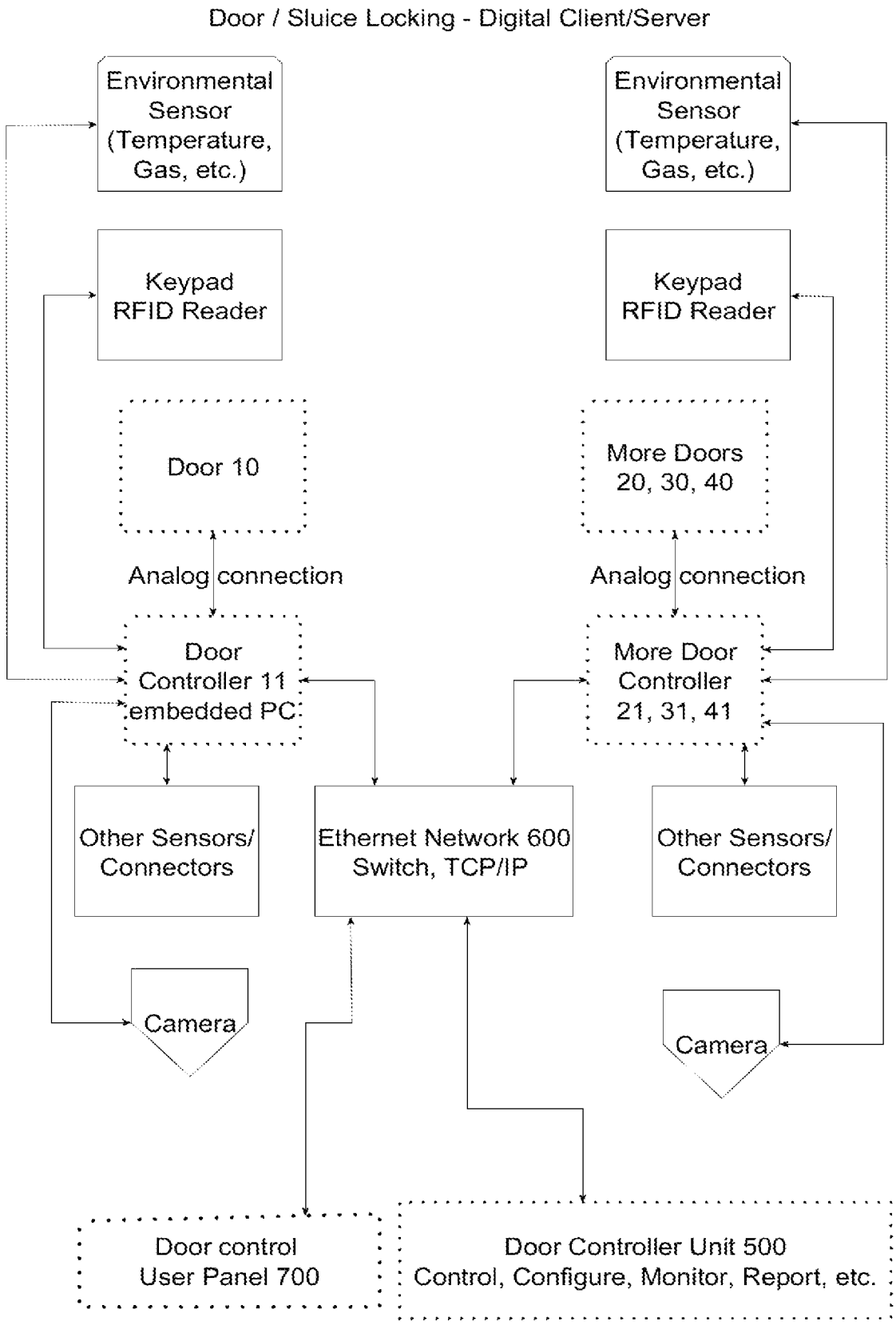
FIG. 1 is a schematic view of a door locking and/or opening system according to the present invention.

The present disclosure will be further described in detail below with reference to the drawings and specific embodiments, in order to better understand the objective, the technical solution and the advantage of the present disclosure. It should be understood that the specific embodiments described herein are merely illustrative and are not intended to limit the scope of the disclosure.

Reference will now be made to the drawing figures to describe the present invention in detail.

Description of Doors, Door Controllers, I/O Controllers and Status

As shown in FIG. 1, a door locking and/or opening system comprises multiple doors 10, 20, 30, 40, multiple door controllers 11, 21, 31, 41, multiple sensors, and a door controller unit 500. Each of the multiple doors 10, 20, 30, 40 is configured with a door ID number, a handle, a lock and an I/O controller which is configured for controlling the corresponding door. Each of the door controllers is connected with the I/O controller of the respective door and controlling the corresponding door. Each of the sensors is connected with the respective door controller and communicating with the corresponding door. The door controller unit 500 is connected with the respective door controller via a decentralized network 600 and is configurated to control the multiple door controllers.

Furthermore, the multiple door controllers are further digitally connected and communicating with each other via the decentralized network 600.

Further, each of the door controllers contains its local logbook of own activities and a configuration file of the complete door locking and/or opening system. In this way, each of the door controllers is configurated to update and synchronize the configuration file with each other in a rotating cycle based on the door ID numbers in an ascending order, beginning with the lowest door ID number.

As an example, according to a selectable time schedule, each of the door controllers periodically updates and synchronizes the local logbook with a central server every ten minutes or every hour or any other selectable time schedule, and each of the door controllers periodically updates and synchronizes the configuration file with each other every ten minutes or every hour or any other selectable time schedule.

A structural description of the system will be present as below.

Door Components

Network Based I/O Controller or USB Based I/O Controller

Network based I/O Controllers may not working encrypted. Thus, if not usable encrypted, they are used only for secondary functions which are restricted to informative purposes but are not used for the sluice function. Security related I/O Adapter will be USB based or embedded to the hardware of the embedded PCs (or door controllers).

Each of doors comprises device for catching the current status of various switches, such like deadbolt switch, Door in Frame switches, various buttons (such as call buttons to open a door, call button for operator, emergency), IR Motion detector, gas sensors (CO, CO2, Temperature, etc.), and other contacts.

The I/O controller will also be used to turn on/off various status lights at a door, such like "locked", "malfunction", "cannot open (for whatever reason)", "open", "do not enter", other lights/items which can be switched on and off. The I/O controller will open or lock the door via controlling a deadbolt mover, switching a magnetic door closer/lock, or controlling the engine for moving a door.

Status Display and/or Touchscreen

Status display and/or touchscreen includes extended options for button functions, status messages, other information.

Webcam

Camera on the door controller is configured for monitoring the area around the door. Camera can be turned on only when door movement is needed, permanent or in any other meaning. Images/Video can be sent to user panel and can be stored together with log information (or local logbook).

Microphone

Microphone can be used for communication with persons inside a sluice lock or acoustic level monitoring.

Loudspeaker

Loudspeaker can be used for communication purposes and/or for acoustic warning/message signals, public announcements, etc.

RFID Reader, Barcode Reader and Iris Reader

If not managed or connected otherwise RFID Reader, Barcode reader and Iris Reader will be connected via USB or I/O Adapter. RFID Reader, Barcode reader and/or Iris Reader are Used for additional authentication of authorized persons for the door/sluice.

IP Cameras are directly connected to a network switch and not listed here.

Other devices, not listened here, still can be able to be connected to a door controller.

Door Controller

The door controllers are implemented as embedded PCs, for example. They have two connection side A and side B. The power supply is with an external power supply or power over Ethernet 600.

The side A is a network connection to a standard network. This communication will be encrypted/signed as described below. The side B is connection to various door components as described below.

The embedded PCs (or door controllers) 11, 21, 31, 41 contains the local logbook for own activities, system status and messages received from other door controllers. The embedded PCs contains a configuration file of the complete system in an encrypted database.

Details about the encryption are written below.

When a central server (or door controller unit) 500 is reachable the local logbook and network activities are copied periodically to the central server and marked in the local database as "transmitted". They will be deleted on an "oldest entry first to delete" basis when the local storage reaches a pre-defined usage level.

The system configuration database contains a version counter for the current and previous configurations. They will also be stored and only deleted on an "oldest configuration first to delete" basis when the local storage reaches a pre-defined usage level.

The local logbook and configuration databases can be placed on different storage devices at an embedded PCs, in order to expand the storage capabilities.

If requested by a central server, the complete logbook and configuration (file) will be sent to the central server. The version number of the configuration (file) will be used by the door controller-to-controller communication, so as to ensure that all door controllers have the current configuration. If needed the newer configuration (file) will be sent to other controllers.

Function Description of Single Parts

Door controller or Embedded PC is located on each single door for controlling the door with various connections. Also used as communication terminal.

User Panel and Configuration Panel

The user panel and configuration panel can be an extra user panel for controlling/Monitoring the system or the user interface from the central server. In small installations the user panel can contain a central server in the background and not a central server as separate device.

Example of possible functions are: "Monitoring current Status of the doors and System", "Activating a Camera/Microphone for surveillance etc.", "Using Loudspeaker for communication/announcements", "Case by Case override of standard configuration", and "Override Configuration with marker "Irrevocable for xxx hours" (Timer will run on each door controller independently).

Various user levels will be configured.

Central Server

The central server is in a door/sluice lock system. In this design the central server is optional and not mandatory. If not existing or failing, the central server can be reloaded by the single door controller with the local logbook and the configuration file. The central server can be used for central logbook storage and evaluation of the complete system.

Conventional systems also have a central server which is required for system functionality.

External Configuration Device

External configuration device mostly is an external Notebook or programming device for setting basic configuration on the door controller, central server, user panel. This basic configuration prevents that an end user or unauthorized person can contaminate a system with unauthorized devices. Without the basic configuration a new item will not be accepted by the system. Notebook/programing device contains a software with special options which are not available to others.

Possible settings are, for example, License code, Encryption Base Key, Signature Base Part of the Salt, Advanced User Management (if not disabled by license), Extended Backup/Restore functions (if not disabled by license), For example, conventional elevators are configured in a similar way.

Network component includes, for example, Network switch for Network Communication.

Cloud connection is connection to external Monitoring/control devices. Cloud connection can be used, for example, for emergency access from an external location with/without override function for the configuration/User interactions.

Description of the Door Locking and/or Opening and Documentation System

Figure 2:
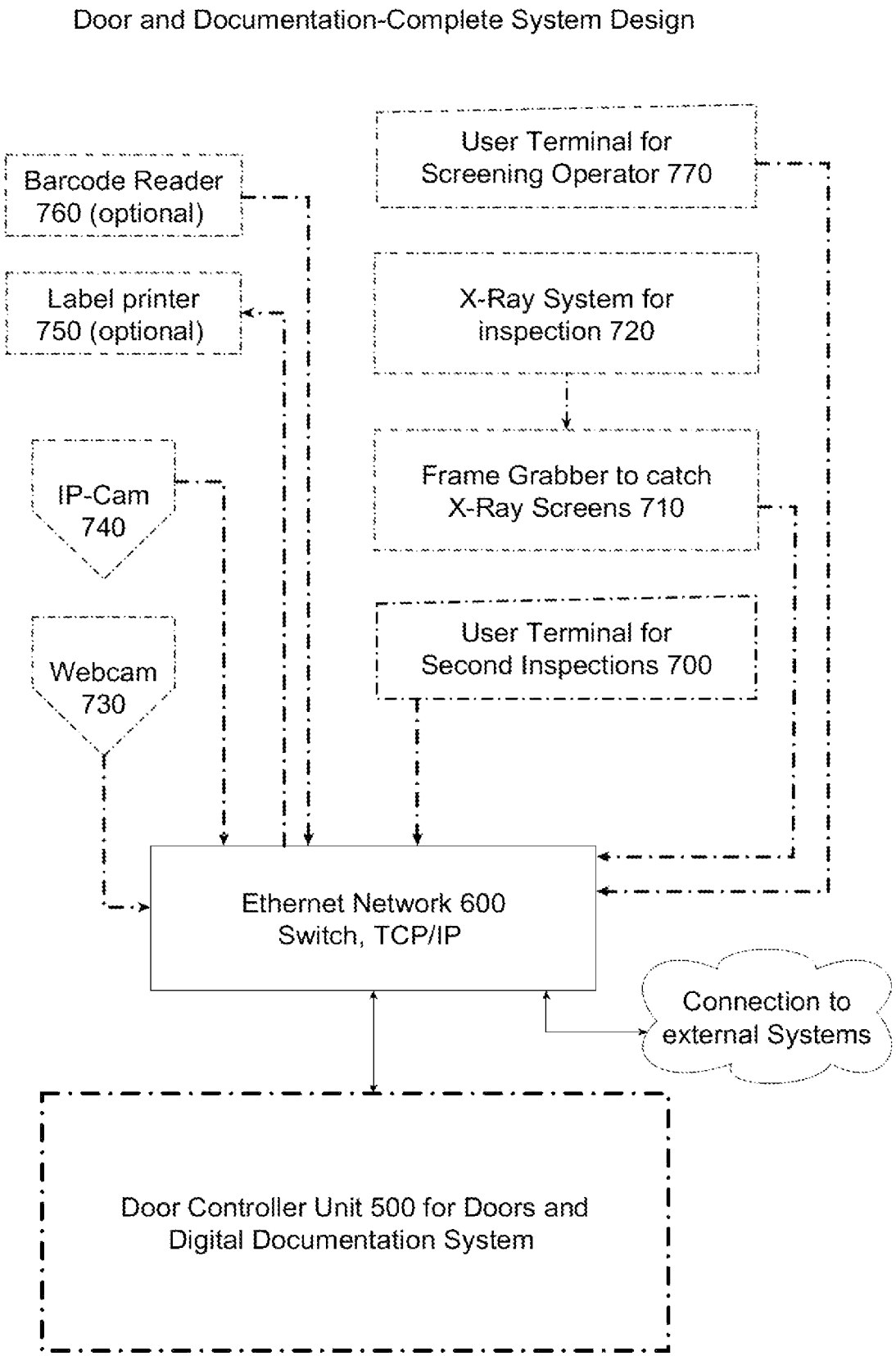
FIG. 2 is a schematic view of a door locking and/or opening and documentation system according to the present invention.

As shown in FIG. 2, a door locking and/or opening and documentation system comprises the door locking and/or opening system as described before and a documentation system. The documentation system comprises a User Terminal for Second Inspections 700, a frame grabber to catch X-Ray Screens 710, an X-Ray system for inspection 720, a Webcam 730, an IP-Cam 740 and a User Terminal for Screening Operator 770.

The door locking and/or opening and documentation system further comprises a Label printer 750 or Barcode Reader 760.

In an embodiment, all the user terminal 700, the frame grabber 710, the X-Ray system 720, the Webcam 730, the IP-Cam 740, the user terminal for Screening Operator 770, the label printer 750 and the barcode Reader 760 are connected through the decentralized network 600.

This represents the mostly common way of handling security inspections for Freight, Goods, Persons, Luggage, etc. The incoming freight will be handled throw all inspection steps. The backoffice handles the complete freight processing. This includes managing to forward to the final destination, returning to sender, discussing with sender about additional security inspection, etc. Freight will be X-Rayed to check content for hazards/forbidden content. Documentation of the X-Ray images will be done inside the X-Ray machine or on an external Hard Disk and can be viewed only on the X-Ray machine. The connection with the freight will be done by the time stamp or comments with information about the checked freight. If X-Ray gives no clear result the freight will be inspected by other ways or the second inspection. At the end of the inspection is the result whether the freight can be forwarded or will be returned to the sender.

The basic operation of the X-ray documentation or inspection documentation takes place, for example, as follows. The object identification (freight item, luggage, etc.), which can be an air waybill or another identification feature, is recorded together with the operator information. Only then are images from the X-ray device (or the X-Ray system for inspection 720) and optionally from the IP camera 740 or the webcam 730 with additional optional information, such as text input with comments or scanned documents, recorded and assigned to this object. This information is saved together with the test result. If a second or additional inspection is necessary, the test process is only saved definitively and unchanged when a final test result is available. This X-ray documentation/inspection documentation is then further used by other areas, e.g. a freight management or access management.

The user terminal for second inspections 700 is a regular computer System with optional Webcams or connected to optional IP Cameras 740 and/or other scanners. The screening operator selects the relevant object identification, analyses the X-Ray image from the first inspection and performs the second inspections. These second inspections can optional recorded by Webcam/IP-Cam. Additional documents can be scanned by document scanners. Other optional devices can be connected to the user terminal 700. After performed inspection, the inspection result, together with optional comments, will be entered in the user terminal 700.

The frame grabber 710 is connected between the computer inside the X-Ray system and the monitor of the X-Ray System. By this way, the content of the monitor will be copied in live time to the documentation system. Still images and video sequences can be recorded by this way. The frame grabber 710 is a one-way device and is technically not able to manipulate the monitor signal from the X-Ray system computer. Thus, the image on the monitor(s) will be displayed unchanged. The frame grabber 710 has no direct user functions. It will be controlled by the software only.

The X-Ray device for security inspection 720 is used to make the contents of an object visible. These X-ray devices 720 have one or more monitors. The shown images can be changed with various device-specific image processing/enhancing functions. The screening operator decides how he wants the images to be displayed. Based on the images, the screening operator decides whether an object can be classified as safe or whether it needs second inspections. The images from the monitors are copied via the frame grabbers 710 and saved for documentation. This method ensures that the images that the screening operator used for his decision are saved in the documentation unchanged.

The user terminal for X-Ray inspections 770 is a regular Computer System connected to the frame grabbers, the optional Webcams or connected to the optional IP Cameras and/or other scanners. The operator selects the relevant object identification and performs the inspection. This inspection can be optionally recorded by the Webcam/IP-Cam 740. Additional documents can be scanned by document scanners. Other optional devices can be connected to the user terminal. Each monitor image, used for a decision by the screening operator can be recorded in the documentation. After performed inspection, the inspection result, together with optional comments, will be entered in the user terminal. The screening operator selects if second inspections are required. The X-Ray inspection and the second inspections are mostly identically performed. The difference is that on the second inspections no X-Ray will be used. The description for the user terminal for X-Ray inspections 770 is mostly identical to the user terminal for second inspections 700.

Description of the Basic Operation

Figure 3:
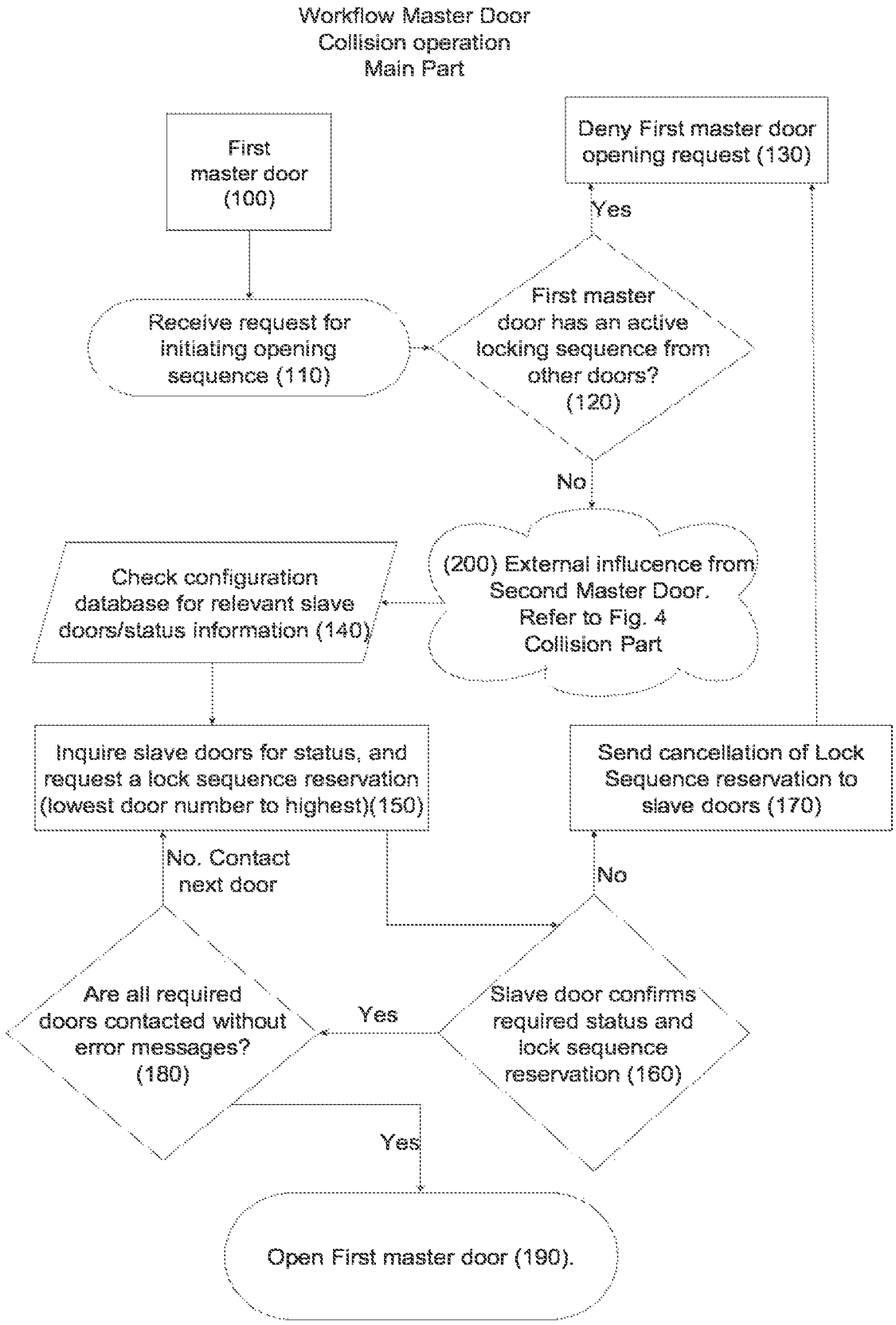
FIG. 3 is a flowchart of a method for controlling door locking and/or opening according to the present invention.

As shown in FIG. 3, a method for controlling door locking and/or opening is applied in a door locking and/or opening system comprising a first master door and multiple slave doors, each slave door associated with a door ID number. The method comprising steps of: receiving 110, by the first master door, a request for initiating an opening sequence; determining 120 whether the first master door have an active locking sequence from other master doors; if the first master door has the active locking sequence from other master doors, denying 130 the door-opening request; if the first master door does not have the active locking sequence from other master doors, checking 140 a configuration database for relevant slave doors and status information; inquiring 150 each of the slave door for its status and requesting a lock sequence reservation, in an order from a lowest door ID number to a highest door ID number, until all slave doors contacted confirms 180 without any error message; determining 160 whether the slave door confirms its status and the lock sequence reservation; if one of the slave doors does not confirm its status and the lock sequence reservation, sending 170 cancellation of the lock sequence reservation to the slave door and denying the door-opening request; opening 190 the first master door, and informing all slave doors when the door is closed again.

Description of the Collision Operation

Figure 4:
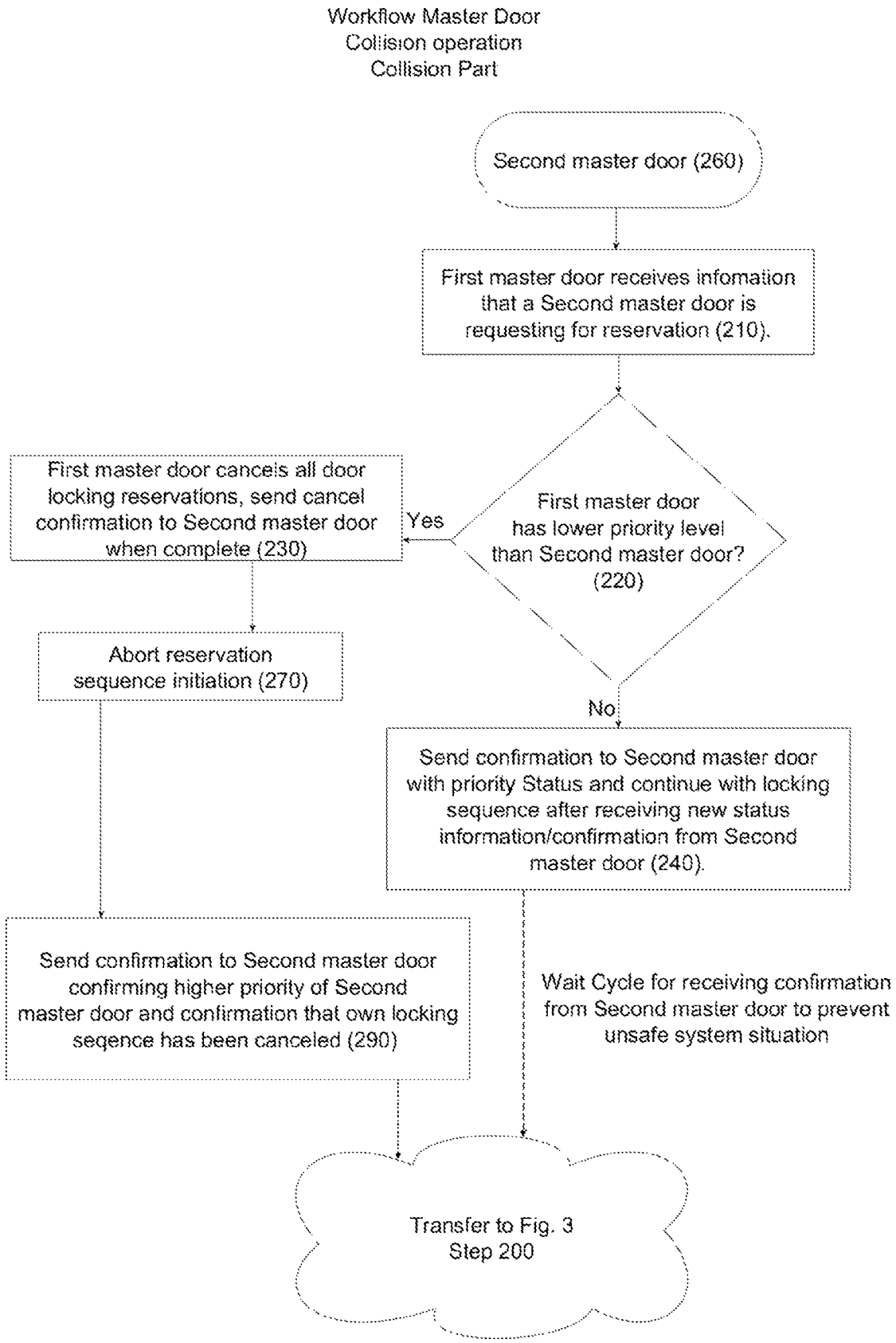
FIG. 4 is a flowchart of a method for controlling door locking and/or opening according to the present invention in case of a collision operation between master doors.

As shown in FIG. 4, after the determining step 120 and before the checking step 140, the method further comprising steps of: informing 210 a second master door that the first master door is requesting for the lock sequence reservation; determining 220 whether the first master door has a lower priority level than the second master door; if the first master door has the higher priority level than the second master door, sending 240 by the second master door a confirmation to the first master door with the higher priority, and continuing by the first master door with the locking sequence reservation until receiving new status information from the second master door; or if the first master door has the lower priority level than the second master door, canceling 230 by the first master door all door locking reservations of the first master door, aborting a reservation sequence initiation 270 by the first master door, and sending a configurable confirmation to the second master door 290.

The confirmation is configurable and can contain separate confirmations. Examples are: (a) Confirmation the higher status to the second door master; (b) Confirmation that the own locking reservation will be canceled; and (c) Confirmation that the own locking reservation has been canceled. These confirmation(s) can be sent in one or more separate messages/confirmations.

Description of the Emergency Opening Operation

Emergency opening and Emergency Closing can be initiated by any door, user panel or optional server. The theory behind is, that an emergency can happen everywhere, every time. Therefore, there is no difference between Master or Slave doors, user panels or optional Servers. An emergency message overrides mostly everything. The only important item is, that the emergency message is correctly encrypted, signed with signature, etc. to have an authentic message.

Priority or first sending to Master Doors coming only in the following situations into effect (after reaching all Master Doors, all other doors, user panels, etc. will be contacted). —Active reservation and one of the doors claims for emergency; —Active reservation and one of the doors has a timeout situation; and—An optional Server or user Panel knows about all active Master Doors and send the emergency order first to all active Master Doors and then to all other doors.

Otherwise, emergency messages will be sent to all doors, etc., depending on the order in the door configuration.

Figure 5:
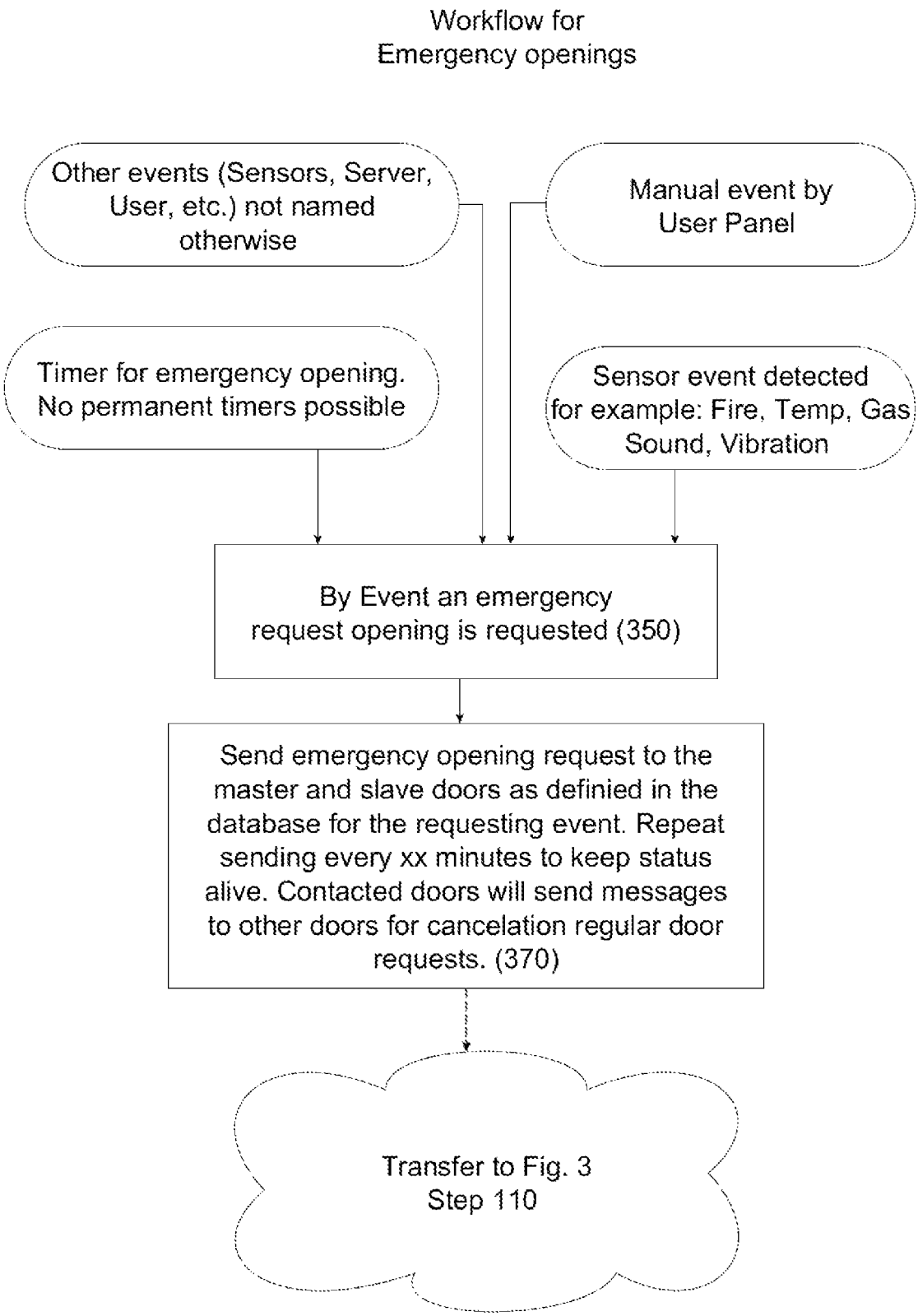
FIG. 5 is a flowchart of a method for controlling door locking and/or opening according to the present invention in case of an emergency opening operation.

As shown in FIG. 5, before the receiving step 110, the method further comprising steps of: detecting, by any one of the master doors or the multiple slave doors, an event where an emergency opening of doors is requested 350; sending an emergency opening request to the master doors and the slave doors as defined in the database for the requesting event periodically or non-periodically 370.

The step of sending is periodically repeated every xx minutes to keep status alive (see configurations for the definition of xx minutes). Contacted doors will send messages to other doors for cancelation regular door requests.

Description of the Emergency Closing Operation

Figure 6:
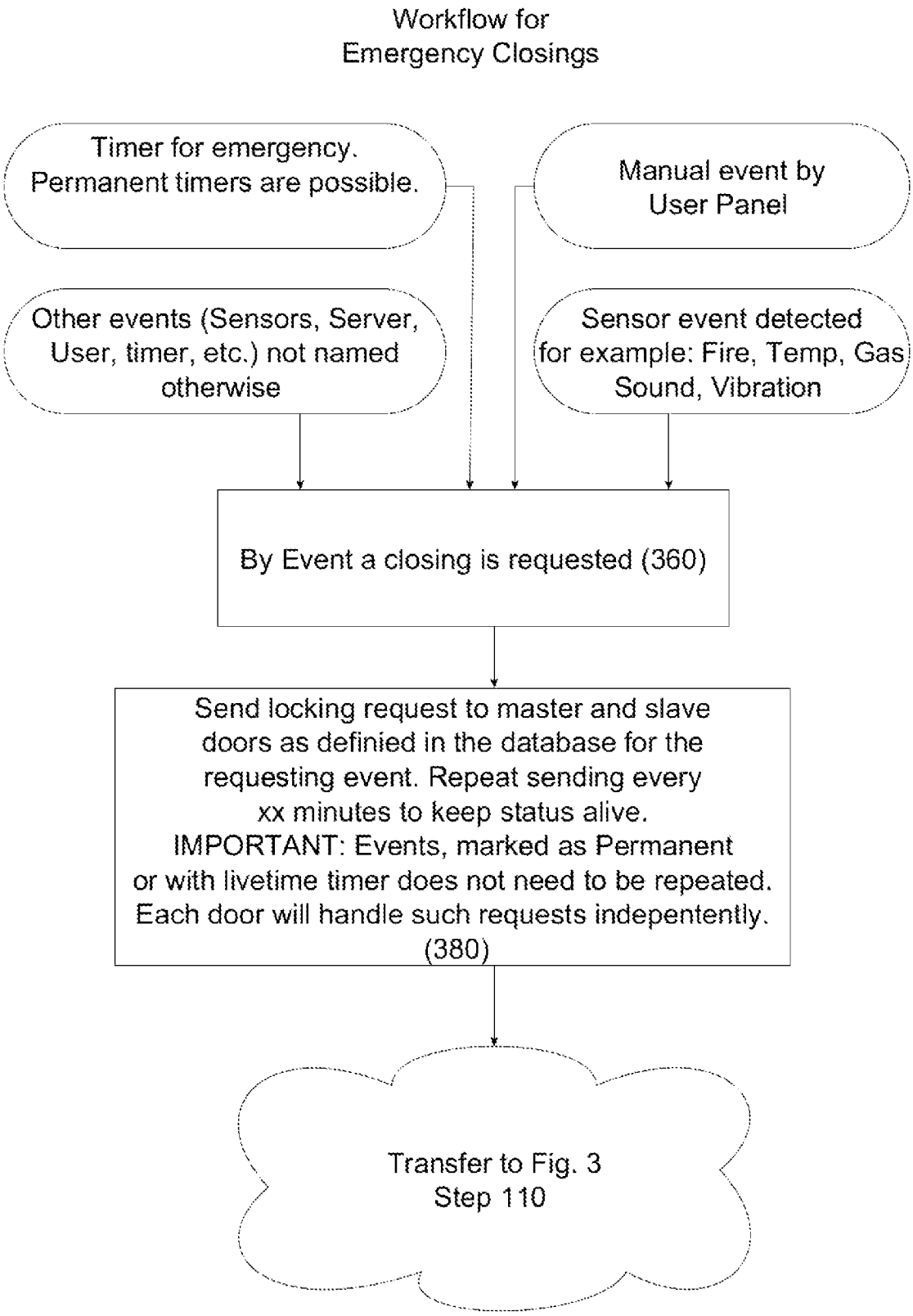
FIG. 6 is a flowchart of a method for controlling door locking and/or opening according to the present invention in case of an emergency closing operation.

As shown in FIG. 6, before the receiving step 110, the method further comprising steps of: detecting, by any one of the master doors or the multiple slave doors, an event where a closing of doors is requested 360; sending a locking request to the master doors and the slave doors as defined in the database for the requesting event periodically or non-periodically 380.

The step of sending is periodically repeated every xx minutes to keep status alive. Events, marked as Permanent or with livetime timer do not need to be repeated. Each door will handle such requests independently.

Description of the Door/Sluice Lock Control

General Communication

A standard TCP/IP v4 Package has a payload of 1452 characters (Calculated from a MTU with 1500, deducting TCP, IPv4 and PPP Headers. This calculates 1500−20−20−8=1452). All Network communication for locking sequences are below this limit. Collision Handling is easier if a locking sequence is transmitted in one frame. All other network communication is not restricted to this size. For IPv6 sizes are adjusted accordingly.

Jumbo frames (IP v4) with a selectable payload maximum of 65488 Characters from a maximum selectable MTU with 65536 will only be used with an individual setting when all components can work with Jumbo frames. Jumbo frames will expand the size of Network communication for locking sequences. For IPv6 sizes are adjusted accordingly.

Contact Sequence

The numbers of the door controllers have in an ascending order. A master door contacts the slave doors in ascending order. This speeds up collision detection.

An optional central server is contacted on each decision step in the workflow. A central server can send a collision information to all members when detected.

Communication includes the version of the configuration settings and the current date/time, in order to prevent mixed configuration and that the clocks in the single door controllers are not working synchronously.

Manual override from a user panel is not included in the workflow, but can add if required. Error handling/faulty doors are not included in the workflows.

If a slave door has a lower configuration version as a master door, the slave door will get and receive the updated configuration (or configuration file) by the master door.

If a master door has a lower configuration version as a slave door, the locking sequence will be performed with the configuration version from the master door. This prevents the situation that a configuration update will slow down the complete system. If required, this behavior can be changed to an "Update master door and repeat locking sequence".

Collision Handling

Collisions can happen in various ways.

When a current collision is handled, additional collisions will be also be managed like the first collision.

When two master doors contacting a slave door at the same time, the TCP/IP Protocol will send one package after the other to the slave door. The first received Network package from the first master door get the priority and the active door lock sequence reservation. All other master doors receive a message about an active door lock sequence reservation.

The second master door gets and receives information about active lock sequence reservation with the ID of the first or primary master door. The first or primary master door gets and receives information about a secondary lock activity. If second master door has a higher Priority level than this first master door, the first master door will cancel its lock sequence reservation and send information message to the second master door when first master door can start its reservation sequence.

When the configured maximum reservation time is reached, the complete locking sequence will be repeated for the configured maximum before an error is shown. This prevents that many collisions will keep some doors locked for a long time and also prevents unneeded/unnecessary restrictions to enter/leave a building/area.

A second master door reaches a slave door with active lock sequence reservation. The second master door gets and receives information about active lock sequence reservation with the ID of the first or primary master.

Both master doors contact each other to verify the locking status and the priority level.

The master door which is selected to cancel the active lock sequence reservation will contact all slave doors and send cancellation. When all cancelations are sent, the working master door starts will send the lock sequence reservation messages.

When the configured maximum reservation time is reached, the complete locking sequence will be repeated for the configured maximum before an error is shown.

Priority action can be from an optional user panel, a central server or a configuration device. If a priority action is valid only for a subset of door controllers, this information is included in the transmitted message. Priority message/order will be sent to all door controller from the door controller unit 500.

The door controller with active lock sequence reservation (master doors or slave doors) submits status to the door controller unit 500 and send also message to door controller with the priority message/order.

Open doors will send an error message to the door controller unit with their status. Depending on priority action, a lock sequence will be completed or aborted.

Description of the Communication Protocol

The single parts of the Sluice lock will be connected with an ethernet connection. Network Protocol will be TCP/IP with IP V4 or IP V6, as needed. The TCP/IP Protocol contains the necessary parts for collision prevention and Bi-directional communication. They will be not described in detail because of being the Prior Art.

The system can be configured to have a cyclic control message sent from each network-connected door controller, the server (or the door controller unit), the panel in a given order and at a given time scale (i.e., time period). Or the system can be a silent system which prevents the unauthorized read out of encrypted network messages.

Operating system based messages will be not suppressed or changed and excluded from the configuration. They are counted as the Prior Art, unless another handling is needed.

Sample Configurations

| Configuration | Description |
|---|---|
| Silent | No cyclic communication from the Control Application. Defective/missing components will be recognized when they do not answer to communication requests. |
| Logbook sync every xx Min. | Every xx minutes each door controller will send a status message to the central server with the latest information about the logbook entries. |
| Configuration sync every xx Min. | Every xx minutes each door controller will send a status message to the central server asking if the current configuration is still valid. |
| Controller to controller check every xx Min. | Every xx minutes the door controllers will communicate to each other to check if the whole system is valid and completely functional. The direction about who contacts whom and who is the failsafe contact will be selected in the configuration (file). |
| Server/Panel to Controller every xx Min. | Every xx minutes the central control server or a user panel is asking the whole system if every component is working and the whole system is functional. |

Communication details for each sample configuration are described below.

The detailed command structure about the transmitted commands and data packages will be described in details later. The description will contain the following parts.

In the following Tables, the "DOOR_ID" is defined as an ascending ID Number of a door controller and the corresponding Network Address.

Log Transmission

The doors send Log messages with the following protocol.

| Field | Content |
|---|---|
| DOOR_ID | ID of the Door who sends the log message. |
| SEND_ID | ID of the local Log entry will be used as Send ID. |
| DATE | Date (as UTC Date) of the logged activity. |
| TIME | Time (as UTC Date) of the logged activity. |
| TIMEZONE | Which Time Zone is used.<br>Possible Entries are for example: UTC; UTC+x; UTC−x |
| TYPE | Fixed word LOGBOOK indicates transmission of a Log Message |
| CONFIG_VERSION | Version number of the configuration Database. |
| TX_TYPE | Indicates if a log transmission will be sent in one transmission or in splitted or separate transmissions. The Type contains the splitting counter.<br>Examples:<br>SINGE—Log transmission in a single Transmission<br>MULTI xxx—Log transmission in multiple Transmission messages. xxx counts the message numbers.<br>_DEL—This will be added to the Type to indicate Log Entries who will be deleted/stripped after confirmed sending. |
| TX_PART | Number of the transmission part. Used only with multiple transmissions. Values ignored by single transmission. |
| ACTIVITY1 | Activity to report.<br>Example of possible entries:<br>ERROR—Error status at the door controller<br>LOCK_GET—Locking inquiries received<br>LOCK_SEND—Locking inquiries send<br>LOCK_DONE—Locking sequences performed<br>IMAGE—Video image recorded<br>AUDIO—Audio Sequence recorded<br>STREAM—Video with/without Audio recorded |
| ACTIVITY2 | Dynamic changed Message Part. Depending on ACTIVITY1.<br>Example for LOCK_GET:<br>No. of Master door, configuration ID, Date/Time of receiving<br>Example for ERROR:<br>Information which sensor/function was not working correctly.<br>Restoring normal state will be sent as another log message.<br>This part can be additional encrypted. |
| SIGNATURE | Hash Signature for Authentic Message. |

The Server confirms the Log messages with the following protocol.

| Field | Content |
|---|---|
| DOOR_ID | ID of the Door who sends the log message. |
| SEND_ID2 | ID and Part of the local Log entry will be used as Send ID2. |
| DATE | Date (as UTC Date) of the logged activity. |
| TIME | Time (as UTC Date) of the logged activity. |
| TIMEZONE | Which Time Zone is used.<br>Possible Entries are for example: UTC; UTC+x; UTC−x. |
| TX_TYPE | Indicates if a transmission will be sent in one transmission or in splitted transmissions. The Type contains the splitting counter.<br>Examples:<br>SINGE—Transmission in a single Transmission<br>MULTI_xxx—Log transmission in multiple Transmission messages. xxx counts the message numbers. |
| TX_PART | Number of the transmission part. Used only with multiple transmissions. Values ignored by single transmission. |

-continued

| Field | Content |
|---|---|
| SIGNATURE_SENT | Sent Signature. This signature will be calculated by the receiving server to confirm correct sending. If this value is not equal with the send Signature, the sending door controller will repeat the message. |
| LOG_ID | ID of the log entry at the central server. |
| SIGNATURE_SERVER | Message Signature from the Server to the sender. |

Configuration Transmission
Sending Configuration

| Field | Content |
|---|---|
| DOOR_ID | ID of the Door who will receive the configuration. The Door ID is configurated outside the network and cannot be changed by configuration messages. To Change the Door ID, it is needed to change the initial door controller Setup. |
| DATE | Date (as UTC Date) of the configuration change. |
| TIME | Time (as UTC Date) of the configuration change. |
| TX_TYPE | Indicates if a transmission will be sent in one transmission or in splitted transmissions. The Type contains the splitting counter.<br>Examples:<br>SINGE—Transmission in a single Transmission<br>MULTI_xxx—Log transmission in multiple Transmission messages. xxx counts the message numbers. |
| TX_PART | Number of the transmission part. Used only with multiple transmissions. Values ignored by single transmission. |
| CONFIG_VERSION | Version number of the configuration Database. |
| TYPE | Type of configuration. To save bandwidth, only the relevant parts will be transmitted and not all fields. Example of possible entries:<br>DOOR—Door Configuration<br>LOCK—Locking settings<br>EMERGENCY—Emergency settings |
| SYSTEM_ID | System ID to contact the correct Door ID with the correct System ID. |
| TIMEOUTLOCKING | Timeout for a locking sequence. |
| ENCYPTION_KEY | Encryption Key changing. The secret will be sent additional to confirm changing of the Encryption Key. |
| KEEPALIVE | Timeframe for sending a message to a central server or to corresponding slave doors. A Zero setting is used to activate a "silent" mode where the controller is only listing and not sending periodical status messages. |
| PERMANENT | Timeframe where a permanent order will be executed if not otherwise specified. |
| PRIORITY | Priority Level. |
| SLAVEDOORCLOSED | Maximum Time a slave door can be locked and closed. |
| DOOROPEN | Maximum Time a door can have the status open. Valid for Master and slave doors. |
| SENSORx | Configuration information for the sensor with No. x. |
| SENSORx_TOOPEN | Sensor No. x can initiate a door opening. |
| SENSORx_TOCLOSE | Sensor No. x shows that a door is closed. |
| SENSORx_FAILTURE | Sensor No. x. |
| SENSORx_EMERGENCYCL | Sensor No. x can initiate an emergency Closing. |
| SENSORx_EMERGENCYOP | Sensor No. x can initiate an emergency Opening. |
| KEEPOPEN | Time a door must be kept open on Emergency. |
| KEEPCLOSED | Time a door must be kept closed on Emergency. |
| CENTRALSERVERx | ID and Network Address of central server No. x. Multiple central servers can be configured. |
| SERVERTIMEOUT | Timeout when a Server is not answering to a Message. |
| SERVERDEAD | Setting in case of a dead server. This represent special door configuration. |
| LOGTRANSFER | Timeframe for sending log entries. |
| CONTROLERCHECK | Timeframe for checking sensors if they are working properly (if supported by sensor). |

-continued

| Field | Content |
|---|---|
| TIMEOUTMESSAGES | Timeout for getting an answer for status messages. |
| CONFIGSYNC | Timeframe for checking slave doors. |
| SLAVE_x | This part can be repeated. Configuration details for Slave door x.<br>Example of possible details:<br>CLOSED—Must be closed<br>FAIL—Own Door must be locked if Failure reported from this door<br>EMERGENCYCLOSE—Close when this door reports an emergency<br>EMERGENCYOPEN—OPEN when this door reports an emergency |
| SIGNATURE | Hash Value to ensure correct message. |

The door controller confirms the Configuration messages with the following protocol.

| Field | Content |
|---|---|
| DOOR_ID | ID of the Door who sends the log message. |
| SEND_ID2 | ID and Part of the local Log entry will be used as Send ID2. |
| DATE | Date (as UTC Date) of the configuration change. |
| TIME | Time (as UTC Date) of the configuration change. |
| TIMEZONE | Which Time Zone is used.<br>Possible Entries are for example: UTC; UTC+x; UTC−x. |
| TX_TYPE | Indicates if a transmission will be sent in one transmission or in splitted transmissions. The Type contains the splitting counter.<br>Examples:<br>SINGE—Transmission in a single Transmission<br>MULTI_xxx—Transmission in multiple Transmission messages. xxx counts the message numbers. |
| TX_PART | Number of the transmission part. Used only with multiple transmissions. Values ignored by single transmission. |
| SIGNATURE_RECEIVED | Signature from received configuration. This signature will be calculated by the receiving door controller to confirm correct sending. If this value is not equal with the send Signature, the sending device will repeat the message. |
| LOG_ID | ID of the log entry. This is to confirm that the message has been accepted. |
| SIGNATURE_SENDER | Message Signature from the Receiver to the sender. |

This part is only used for the initial door controller Setup. This can be only done by Trained/Certified personnel. Transmission is not limited to Network communication, but also can be done by a special encoded USB device.

| Field | Content |
|---|---|
| DEVICE_ID | ID of the Device who will receive the configuration. The System ID is calculated on Hardware characteristics and identify the Hardware of a controller. It can be, for example, the CPU ID, Mainboard ID, Network Adapter ID or a randomized ID, created by the Software for individual identification. |
| DATE | Date (as UTC Date) of the Initial Setup. |
| TIME | Time (as UTC Date) of the Initial Setup. |
| TX_TYPE | Indicates if a transmission will be sent in one transmission or in splitted transmissions. The Type contains the splitting counter.<br>Examples:<br>SINGE—Transmission in a single Transmission<br>MULTI_xxx—Log transmission in multiple Transmission messages. xxx counts the message numbers. |
| TX_PART | Number of the transmission part. Used only with multiple transmissions. Values ignored by single transmission. |
| CONFIG_VERSION | Internal Config Version of Initial door controller Setup. |
| DOOR_ID | ID Number of the Door and the Network Address of the Door. |
| SYSTEM_ID | ID of the System where the door controller is used. |
| ENCYPTION_KEY | Own encryption Key for creating signatures. Can be changed by central configuration if needed. |

-continued

| Field | Content |
|---|---|
| SECRET | Secret Key. Required to change initial Door setup after first configuration. If not known, the door controller must be set up from the earliest beginning. |
| SIGNATURE | Hash Value to ensure correct message. |

Regular Communication Between the Single Parts

| Field | Content |
|---|---|
| SENDER_DOOR_ID | ID of the Door who will receive the configuration. The Door ID is configurated outside the network and cannot be changed by configuration messages. To Change the Door ID, it is needed to change the initial door controller Setup. |
| RECEIVER_DOOR_ID | Double Confirmation who is the receiver of the Message. |
| DATE | Date (as UTC Date) of the Communication. |
| TIME | Time (as UTC Date) of the Communication. |
| TX TYPE | Indicates if a transmission will be sent in one transmission or in splitted transmissions. The Type contains the splitting counter.<br>Examples:<br>SINGE—Transmission in a single Transmission<br>MULTI_xxx—Log transmission in multiple Transmission messages. xxx counts the message numbers. |
| TX_PART | Number of the transmission part. Used only with multiple transmissions. Values ignored by single transmission. |
| CONFIG_VERSION | Version number of the configuration Database. |
| TYPE | Type of Communication. To save bandwidth, only the relevant parts will be transmitted and not all fields.<br>Example of possible entries:<br>ACTION—Locking Action Messages<br>FAILURE—Failure Messages<br>EMC—Emergency Messages<br>ALIVE—Alive Messages<br>TIMESYNC—Additional Time Synchronization Message |
| PARAMETER_x | This part can be repeated. These parameters contain the specific commands, needed for the selected TYPE. |
| SIGNATURE | Hash Value to ensure correct message. |

The door controller confirms the regular messages with the following protocol.

| Field | Content |
|---|---|
| DOOR_ID | ID of the Door who sends the log message. |
| SEND_ID2 | ID and Part of the local Log entry will be used as Send ID2. |
| DATE | Date (as UTC Date) of the Communication. |
| TIME | Time (as UTC Date) of the Communication. |
| TIMEZONE | Which Time Zone is used.<br>Possible Entries are for example: UTC; UTC+x; UTC−x. |
| TX_TYPE | Indicates if a transmission will be sent in one transmission or in splitted transmissions. The Type contains the splitting counter.<br>Examples:<br>SINGE—Transmission in a single Transmission<br>MULTI_xxx—Transmission in multiple Transmission messages. xxx counts the message numbers. |
| TX_PART | Number of the transmission part. Used only with multiple transmissions. Values ignored by single transmission. |
| PARAMETER_x | This part can be repeated. These parameters contain the specific answers if needed for the selected TYPE. |
| SIGNATURE_RECEIVED | Signature from received configuration. This signature will be calculated by the receiving door controller to confirm correct sending. If this value is not equal with the send Signature, the sending device will repeat the message. |
| LOG_ID | ID of the log entry. This is to confirm that the message has been accepted. |
| SIGNATURE_SENDER | Message Signature from the Receiver to the sender. |

Database Configuration

The system will have various databases as described below. All databases are encrypted and secured with signatures.

Log Database

Log Database contains logbook of each activity of a single door controller, the central server, the user panel, etc. The logbook can be used to playback the activity of all doors and users. If User ID can be tracked by RFID, Barcode, etc., the movement of an individual object can be tracked and recovered.

Optional entries can be used, but must not. They are reserved for further usage. Local Log Database and Central Log Database have identical structure, in order for better maintenance of the software.

| Field | Description |
|---|---|
| Entry No. | Record No./Index. |
| Date | Date of record in local time. |
| Time | Time of record in local time. |
| Time zone | Time zone information for recalculation in UTC. |
| Date UTC | Date of record in UTC Time. Used to have a collision free date if the time is around midnight to prevent questionable dates. (Optional entry). |
| Time UTC | Time of record in UTC Time (Optional entry). |
| Door ID | ID of the Door who has created the Log entry. |
| Door Log ID | Local Log ID from the Door. This entry is mostly used to perform additional tests when resending log entries from the doors to the central server. |
| Configuration Version | Version ID of the used configuration. |
| System ID | System ID of the Installation. This Field makes it possible to have a central log server for several installations. Each installation can be identified by this Field. The salt for the Signatures is depending on the System ID. Therefore, different Salts for different installations can be used in one database. |
| Slave Door | Door which has been contacted. Own door activities will have the own Door ID in this field. If no Slave Door was involved, this field will contain a dummy entry for Signature Calculation. |
| Activity | Activity details.<br>Possible details are for example:<br>Status request from a door<br>Reservation of Sluice procedure<br>Receive status request from a door<br>Send error status to a door<br>Send error status to Server<br>Receive error status from a door<br>Receive Reservation request from a door<br>Receive of configuration<br>Request to send Logbook complete/only new<br>Request to send Configuration (current/all histories)<br>Override from Server or User Panel<br>Irrevocable order from Server or User Panel<br>Communication request/established communication<br>Camera activation<br>Pressed buttons<br>Door Status of each individual connected sensor<br>Door Movements<br>Send/receive Reservation cancellation for Sluice procedure |
| Signature 1 | Signature for the fields until this field. This signature will never be changed. Signature 2 is changeable as described at Signature 2. |
| Transmitted to Server | ID of the central server who has received the logbook entries. |
| Ticket No. from Server | Ticket Number is the record number from the central server under which this log entry is recorded at the central server. |
| Transmission Date | Date when the Log entry has been transmitted to the central server. This Date is when the ticket from the server has been received. If UTC field is used, this Date is UTC Date, otherwise local date. |
| Transmission Time | Time when the Log entry has been transmitted to the central server. This Time is when the ticket from the server has been received. If UTC field is used, this Time is UTC Time, otherwise local Time. |
| Signature 2 | Signature of the complete Fields including Signature 1. This signature will be changed when the Log Record has been transmitted to a central server. |
| Record file | OPTIONAL: Storage of the whole logbook record as additional encrypted file. Only recommended in environments with extended security requirements. |

Configuration Database

Configuration Database contains Configuration of the sluice function, encryption details, failback procedures, door ID's, etc. Each complete configuration (or configuration file) has a version number and signature. This enables that the whole system can check itself whether the configuration is identical or various door controllers have various configuration versions.

This structure is mostly identical to the configuration transmission.

| Field | Content |
|---|---|
| DOOR_ID | ID of the Door where the following configuration belongs to. The Door ID is configurated outside the network and cannot be changed by configuration messages. To change the Door ID, it is needed to change the initial door controller Setup. |
| DATE | Date (as UTC Date) of the record. |
| TIME | Time (as UTC Date) of the record. |
| CONFIG_VERSION | Version number of the configuration Database. |
| TYPE | Type of configuration settings. A door configuration contains many settings. To sort them into groups they are grouped into different types.<br>Example of possible entries:<br>DOOR—Door Configuration<br>LOCK—Locking settings<br>EMERGENCY—Emergency settings |
| SYSTEM_ID | System ID to contact the correct Door ID with the correct System ID. |
| TIMEOUTLOCKING | Timeout for a locking sequence. |
| ENCYPTION_KEY | Encryption Key changing. The secret will be sent additional to confirm changing of the Encryption Key. |
| KEEPALIVE | Timeframe for sending a message to a central server or to corresponding slave doors. A Zero setting is used to activate a "silent" mode where the controller is only listing and not sending periodical status messages. |
| PERMANENT | Timeframe where a permanent order will be executed if not otherwise specified. |
| PRIORITY | Priority Level. |
| SLAVEDOORCLOSED | Maximum Time a slave door can be locked and closed. |
| DOOROPEN | Maximum Time a door can have the status open. Valid for Master and slave doors. |
| SENSORx | Configuration information for the sensor with No. x. |
| SENSORx_TOOPEN | Sensor No. x can initiate a door opening. |
| SENSORx_TOCLOSE | Sensor No. x shows that a door is closed. |
| SENSORx_FAILTURE | Sensor No. x. |
| SENSORx_EMERGENCYCL | Sensor No. x can initiate an emergency Closing. |
| SENSORx_EMERGENCYOP | Sensor No. x can initiate an emergency Opening. |
| KEEPOPEN | Time a door must be kept open on Emergency. |
| KEEPCLOSED | Time a door must be kept closed on Emergency. |
| CENTRALSERVERx | ID and Network Address of central server No. x. Multiple central servers can be configured. |
| SERVERTIMEOUT | Timeout when a Server is not answering to a Message. |
| SERVERDEAD | Setting in case of a dead server. This represent special door configuration. |
| LOGTRANSFER | Timeframe for sending log entries. |
| CONTROLERCHECK | Timeframe for checking sensors if they are working properly (if supported by sensor). |
| TIMEOUTMESSAGES | Timeout for getting an answer for status messages. |
| CONFIGSYNC | Timeframe for checking slave doors. |
| SLAVE_x | This part can be repeated. Configuration details for Slave door x.<br>Example of possible details:<br>CLOSED—Must be closed<br>FAIL—Own Door must be locked if Failure reported from this door<br>EMERGENCYCLOSE—Close when this door reports an emergency<br>EMERGENCYOPEN—OPEN when this door reports an emergency |
| SIGNATURE | Hash Value to ensure correct storage. |

System Database

This System database contains the individual system information. And System database individualizes the whole system. Unconfigured devices without this System database will be ignored by the complete system and recorded in the logbook as detected intruders. External configuration devices need to have a copy of the system database in order to be recognized.

This structure is mostly identical to the configuration transmission.

| Field | Content |
|---|---|
| SYSTEM_ID | System ID from the whole installation. |
| DATE | Date (as UTC Date) of the record. |
| TIME | Time (as UTC Date) of the record. |
| CONFIG_VERSION | Internal Config Version of Initial door controller Setup. |
| ENCYPTION KEY | Encryption key of the whole system. |
| DOOR_ID | ID Number of the Door and the Network Address of the Door |
| DEVICE_ID | Device ID from a Door ID. Only stored on a central server or external. Not stored on other devices. Required only to change initial values of a Door controller. |
| SECRET | Secret Key. Required to change initial Door setup after first configuration. If not known, the door controller must be set up from the earliest beginning. Only stored on a central server or external. Not stored on other devices. Required only to change initial values of a Door controller. |
| SIGNATURE | Hash Value to ensure correct record storage. |

Encrypted/Secured Storage and Transmission of Configuration File, System Communication and Logbook Encryption, signature, etc. will be available as selectable items. The End-user can select which parts of the encryption will be activated and used. An option to restrict the selection with licensing options will also be possible.

Additional to the encryption, the encrypted message/information can be stored/transmitted, for example via RGB color pattern (where the question is how to read the single pixels of the pattern and how the binary information has been transformed to color RGB information) or via Pseudo Base64 string (where the conversation table such as abcdefg . . . has been modified to a different table such as bcDefG . . . ).

Without the information on how the information has been transformed, the content cannot be decrypted.

While the disclosure has been described by way of example and in terms of exemplary embodiment, it is to be understood that the disclosures is not limited thereto. It is to be understood that the above-described embodiments are merely illustrative and not restrictive. To the contrary, it is intended to lamp shade various modifications and similar arrangements (as would be apparent to those skilled in the art).

It will be readily understood by those skilled in the art that the above various preferred embodiments can be freely combined and superimposed without conflict. Various obvious or equivalent modifications or alterations to the above-described details will be included in the scope of the claims of the present disclosure without departing from the basic principles of the application. Therefore, the scope of the appended claims should be accorded the broadest interpretation so as to encompass all such modifications and similar arrangements.

What is claimed is:

1. A door locking and/or opening system for use in a building, comprising:

multiple doors (10; 20; 30; 40), each configured with a door ID number, a handle, a lock and an I/O controller, the I/O controller is configured for controlling the corresponding door;

multiple door controllers (11; 21; 31; 41), each of the door controllers connected with the I/O controller of the respective door and controlling the corresponding door;

multiple sensors, each of the sensors connected with the respective door controller and communicating with the corresponding door;

a door controller unit (500), connected with the respective door controller via a decentralized network (600) and controlling the multiple door controllers;

characterized in that:

the multiple door controllers are further digitally connected and communicating with each other via the decentralized network (600);

each of the door controllers contains its local logbook of own activities and a configuration file of the complete door locking and/or opening system; and each of the door controllers is further configurated to periodically update and synchronize the configuration file with each other in a rotating cycle based on the door ID numbers in an ascending order, beginning with the lowest door ID number, so as to ensure that all door controllers have the current configuration file.

2. The door locking and/or opening system in claim 1, wherein each of the door controllers (11; 21; 31; 41) updates and synchronizes the local logbook with a central server according to a first selectable time schedule, and each of the door controllers (11; 21; 31; 41) updates and synchronizes the configuration file with each other according to a second selectable time schedule.

3. The door locking and/or opening system in claim 1, wherein the network communication among the multiple door controllers is encrypted and signed.

4. The door locking and/or opening system in claim 1, wherein the door controller unit (500) is configured to maintain the configuration file, to distribute the configuration file to the door controllers (11; 21; 31; 41), to store the local logbooks and to monitor the actions of each door controller in order to identify malfunctions or manipulations.

5. The door locking and/or opening system in claim 1, wherein the I/O controllers are a network-based I/O controller or a USB-based I/O controller, which is configurated to open or lock the corresponding door.

6. The door locking and/or opening system in claim 1, wherein the system further comprises a door control user panel (700), the door control user panel communicates with the door controller unit and or with the network of the individual door controller.

7. A door locking and/or opening and documentation system for use in a building, comprising:

the door locking and/or opening system in claim 1, wherein a documentation system comprising:

a user terminal for second inspections (700);

a frame grabber to catch X-Ray screens (710);

an X-Ray system for inspection (720);

a webcam (730);

an IP-cam (740); and a user terminal for screening operator (770).

8. The door locking and/or opening and documentation system in claim 7, wherein the system further comprises a label printer (750) or a barcode reader (760).

9. A method for controlling door locking and/or opening for use in a building, said method applied in a door locking and/or opening system comprising a first master door and multiple slave doors, each slave door associated with a door ID number, said method comprising steps of:

receiving (110), by the first master door, a request for initiating an opening sequence;

determining (120) whether the first master door have an active locking sequence from other master doors;

if the first master door has the active locking sequence from other doors, denying (130) the door-opening request;

if the first master door does not have the active locking sequence from other master doors, checking (140) a configuration database for relevant slave doors and status information;

inquiring (150) each of the slave door for its status and requesting a lock sequence reservation, in an order from a lowest door ID number to a highest door ID number, until all slave doors contacted confirms (180) without any error message, wherein determining (160) whether the slave door confirms its status and the lock sequence reservation;

if one of the slave doors does not confirm its status and the lock sequence reservation, sending (170) cancellation of the lock sequence reservation to the slave door and denying the door-opening request; and opening the first master door (190), and informing all slave doors when the door is closed again.

10. The method in claim 9, after the determining step (120) and before the checking step (140), the method further comprising steps of:

informing (210) a second master door that the first master door is requesting for e lock sequence reservation;

determining (220) whether the first master door has a lower priority level than the second master door;

if the first master door has the higher priority level than the second master door, sending (240) by the second master door a confirmation to the first master door with the higher priority, and continuing by the first master door with the locking sequence reservation until receiving new status information from the second master door; or if the first master door has the lower priority level than the second master door, canceling (230) by the first master door all door locking reservations of the first master door, aborting a reservation sequence initiation (270) by the first master door, and sending a configurable confirmation to the second master door (290).

11. The method in claim 9, before the receiving step (110), the method further comprising steps of:

detecting, by any one of the master doors or the multiple slave doors, an event where an emergency opening of doors is requested (350); and sending an emergency opening request to the master doors and the slave doors as defined in the database for the requesting event periodically or non-periodically (370).

12. The method in claim 9, before the receiving step (110), the method further comprising steps of:

detecting, by any one of the master doors or the multiple slave doors, an event where a closing of doors is requested (360); and sending a locking request to the master doors and the slave doors as defined in the database for the requesting event periodically or non-periodically (380).

13. The method in claim 10, wherein when a pre-configured maximum reservation timer is reached, the complete locking sequence is repeated for the configured maximum reservation duration before an error is shown, so as to prevent that some of the doors are kept locked and prevent restrictions to enter or leave an area.

14. The method in claim 9, wherein a locking sequence is transmitted in one frame.

15. The method in claim 10, wherein a locking sequence is transmitted in one frame.

16. The method in claim 11, wherein a locking sequence is transmitted in one frame.

17. The method in claim 10, before the receiving step (110), the method further comprising steps of:

detecting, by any one of the master doors or the multiple slave doors, an event where an emergency opening of doors is requested (350); and sending an emergency opening request to the master doors and the slave doors as defined in the database for the requesting event periodically or non-periodically (370).

18. The method in claim 10, before the receiving step (110), the method further comprising steps of:

detecting, by any one of the master doors or the multiple slave doors, an event where a closing of doors is requested (360); and sending a locking request to the master doors and the slave doors as defined in the database for the requesting event periodically or non-periodically (380).

* * * * *